US008831937B2

(12) United States Patent
Murgia et al.

(10) Patent No.: US 8,831,937 B2
(45) Date of Patent: Sep. 9, 2014

(54) POST-NOISE SUPPRESSION PROCESSING TO IMPROVE VOICE QUALITY

(75) Inventors: Carlo Murgia, Sunnyvale, CA (US); Scott Isabelle, Sunnyvale, CA (US)

(73) Assignee: Audience, Inc., Mountain View, CA (US)

( * ) Notice: Subject to any disclaimer, the term of this patent is extended or adjusted under 35 U.S.C. 154(b) by 431 days.

(21) Appl. No.: 13/295,981

(22) Filed: Nov. 14, 2011

(65) Prior Publication Data

US 2012/0123775 A1 May 17, 2012

Related U.S. Application Data

(60) Provisional application No. 61/413,272, filed on Nov. 12, 2010.

(51) Int. Cl.
*G10L 21/02* (2013.01)

(52) U.S. Cl.
CPC ..... *G10L 21/0205* (2013.01)
USPC ..... 704/228; 704/226; 704/221; 704/233

(58) Field of Classification Search
CPC ..... H04R 5/00
USPC ..... 704/229, E19.042, E19.043, E19.044, 704/233, 226–228, 214, 221, 208, 500, 219, 704/210
See application file for complete search history.

(56) References Cited

U.S. PATENT DOCUMENTS

| | | | | |
|---|---|---|---|---|
| 6,421,388 | B1 * | 7/2002 | Parizhsky et al. | 375/243 |
| 6,862,567 | B1 * | 3/2005 | Gao | 704/228 |
| 6,907,045 | B1 * | 6/2005 | Robinson et al. | 370/466 |
| 7,058,574 | B2 * | 6/2006 | Taniguchi et al. | 704/233 |
| 7,366,658 | B2 * | 4/2008 | Moogi et al. | 704/205 |
| 7,383,179 | B2 * | 6/2008 | Alves et al. | 704/228 |
| 7,617,099 | B2 * | 11/2009 | Yang et al. | 704/228 |
| 2001/0041976 | A1 * | 11/2001 | Taniguchi et al. | 704/226 |
| 2004/0133421 | A1 * | 7/2004 | Burnett et al. | 704/215 |
| 2005/0027520 | A1 * | 2/2005 | Mattila et al. | 704/228 |
| 2005/0096904 | A1 * | 5/2005 | Taniguchi et al. | 704/226 |
| 2005/0143989 | A1 * | 6/2005 | Jelinek | 704/226 |
| 2006/0293882 | A1 * | 12/2006 | Giesbrecht et al. | 704/204 |
| 2007/0136056 | A1 * | 6/2007 | Moogi et al. | 704/227 |

(Continued)

OTHER PUBLICATIONS

Jelinek et al. "Noise Reduction Method for Wideband Speech Coding" 2004.*

(Continued)

*Primary Examiner* — Vijay B Chawan
(74) *Attorney, Agent, or Firm* — Carr & Ferrell LLP

(57) ABSTRACT

Provided are methods and systems for improving quality of speech communications. The method may be for improving quality of speech communications in a system having a speech encoder configured to encode a first audio signal using a first set of encoding parameters associated with a first noise suppressor. A method may involve receiving a second audio signal at a second noise suppressor which provides much higher quality noise suppression than the first noise suppressor. The second audio signal may be generated by a single microphone or a combination of multiple microphones. The second noise suppressor may suppress the noise in the second audio signal to generate a processed signal which may be sent to a speech encoder. A second set of encoding parameters may be provided by the second noise suppressor for use by the speech encoder when encoding the processed signal into corresponding data.

30 Claims, 6 Drawing Sheets

(56) References Cited

U.S. PATENT DOCUMENTS

| | | | | |
|---|---|---|---|---|
| 2007/0150268 | A1* | 6/2007 | Acero et al. | 704/226 |
| 2007/0154031 | A1* | 7/2007 | Avendano et al. | 381/92 |
| 2007/0237271 | A1* | 10/2007 | Pessoa et al. | 375/346 |
| 2007/0244695 | A1* | 10/2007 | Manjunath et al. | 704/201 |
| 2008/0195384 | A1* | 8/2008 | Jabri et al. | 704/221 |
| 2008/0310646 | A1* | 12/2008 | Amada | 381/73.1 |
| 2009/0012783 | A1* | 1/2009 | Klein | 704/226 |
| 2009/0012784 | A1* | 1/2009 | Murgia et al. | 704/230 |
| 2009/0048824 | A1* | 2/2009 | Amada | 704/10 |
| 2009/0070118 | A1* | 3/2009 | Den Brinker et al. | 704/500 |
| 2009/0119099 | A1* | 5/2009 | Lee et al. | 704/226 |
| 2009/0192790 | A1* | 7/2009 | El-Maleh et al. | 704/219 |
| 2009/0226005 | A1* | 9/2009 | Acero et al. | 381/92 |
| 2009/0287481 | A1* | 11/2009 | Paranjpe et al. | 704/226 |
| 2009/0292536 | A1* | 11/2009 | Hetherington et al. | 704/225 |
| 2009/0323982 | A1* | 12/2009 | Solbach et al. | 381/94.3 |
| 2010/0004929 | A1* | 1/2010 | Baik | 704/233 |
| 2010/0211385 | A1* | 8/2010 | Sehlstedt | 704/214 |
| 2010/0228545 | A1* | 9/2010 | Ito et al. | 704/226 |
| 2010/0280824 | A1* | 11/2010 | Petit et al. | 704/214 |
| 2011/0184734 | A1* | 7/2011 | Wang et al. | 704/233 |
| 2011/0208520 | A1* | 8/2011 | Lee | 704/233 |
| 2011/0257965 | A1* | 10/2011 | Hardwick | 704/208 |
| 2011/0264449 | A1* | 10/2011 | Sehlstedt | 704/226 |
| 2012/0116758 | A1* | 5/2012 | Murgia et al. | 704/226 |

OTHER PUBLICATIONS

Widjaja et al. "Application of Differential Microphone Array for IS-127 EVRC Rate Determination Algorithm" Sep. 2009.*

Tashev et al. "Microphone Array for Headset With Spatial Noise Suppressor" 2005.*

Sugiyama et al. "Single-Microphone Noise Suppression for 3G Handsets Based on Weighted Noise Estimation" 2005.*

Watts. "Real-Time, High-Resolution Simulation of the Auditory Pathway, with Application to Cell-Phone Noise Reduction" Jun. 2010.*

"Minimum Performance Specification for the Enhanced Variable Rate Codec, Speech Service Options 3 and 68 for Wideband Spread Spectrum Digital Systems" Jul. 2007.*

3GPP2 "Enhanced Variable Rate Codec, Speech Service Options 3, 68, 70, and 73 for Wideband Spread Spectrum Digital Systems", May 2009, pp. 1-308.

3GPP2 "Selectable Mode Vocoder (SMV) Service Option for Wideband Spread Spectrum Communication Systems", Jan. 2004, pp. 1-231.

3GPP2 "Source-Controlled Variable-Rate Multimode Wideband Speech Codec (VMR-WB) Service Option 62 for Spread Spectrum Systems", Jun. 11, 2004, pp. 1-164.

3GPP "3GPP Specification 26.071 Mandatory Speech Codec Speech Processing Functions; AMR Speech Codec; General Description", http://www.3gpp.org/ftp/Specs/html-info/26071.htm, accessed on Jan. 25, 2012.

3GPP "3GPP Specification 26.094 Mandatoy Speech Codec Speech Processing Functions; Adaptive Multi-Rate (AMR) Speech Codec; Voice Activity Detector (VAD)", http://www.3gpp.org/ftp/Specs/html-info/26094.htm, accessed on Jan. 25, 2012.

3GPP "3GPP Specification 26.171 Speech Codec Speech Processing Functions; Adaptive Multi-Rate—Wideband (AMR-WB) Speech Codec; General Description", http://www.3gpp.org/ftp/Specs/html-info26171.htm, accessed on Jan. 25, 2012.

3GPP "3GPP Specification 26.194 Speech Codec Speech Processing Functions; Adaptive Multi-Rate—Wideband (AMR-WB) Speech Codec; Voice Activity Detector (VAD)" http://www.3gpp.org/ftp/Specs/html-info26194.htm, accessed on Jan. 25, 2012.

International Telecommunication Union "Coding of Speech at 8 kbit/s Using Conjugate-Structure Algebraic-code-excited Linear-prediction (CS-ACELP)", Mar. 19, 1996, pp. 1-39.

International Telecommunication Union "Coding of Speech at 8 kbit/s Using Conjugate Structure Algebraic-code-exicited Linear-prediction (CS-ACELP) Annex B: A Silence Compression Scheme for G.729 Optimized for Terminals Conforming to Recommendation V.70", Nov. 8, 1996, pp. 1-23.

* cited by examiner

POST-NOISE SUPPRESSION PROCESSING TO IMPROVE VOICE QUALITY

CROSS REFERENCES TO RELATED APPLICATIONS

This nonprovisional patent application claims priority benefit of U.S. Provisional Patent Application No. 61/413,272, filed Nov. 12, 2010, titled: "Post-Noise Suppression Processing to Improve Voice Quality," which is hereby incorporated by reference in its entirety.

TECHNICAL FIELD

The application generally relates to speech communication devices, and more specifically to improving audio quality in speech communications by adjusting speech encoder parameters.

BACKGROUND

A speech encoder is typically used to process noisy speech and tested with a moderate level of noise. Substantial background noises are common in speech communications, and noise suppressors are widely used for suppressing these background noises before the speech is encoded by a speech encoder. A noise suppressor improves the speech signal by reducing the level of noise, which may be used to improve voice signal quality. However, when noises are being removed from the initial audio signal, spectral and temporal modifications to the speech signal may be introduced in a manner that is not known to the speech encoder. Because the speech encoder may be tuned to a specific built-in noise suppressor, bypassing the original built-in noise suppressor or otherwise modifying the built-in suppressor may cause the speech encoder to misclassify speech and noise. This misclassification may result in wasting data and a suboptimal audio signal.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Provided are methods and systems for improving quality of speech communications by adjusting the speech encoder's parameters. The system may have a speech encoder configured to encode a first audio signal using a first set of parameters associated with a first noise suppressor. A new suppressor (e.g., a high quality noise suppressor) may be introduced into the system. The method may commence with receiving a second set of parameters associated with a second noise suppressor. The method may further include reconfiguring the speech encoder to encode a second audio signal using the second set of parameters.

In some embodiments, the method may commence with the noise suppressor receiving an audio signal. The signal may be generated by a single microphone or by a combination of multiple microphones. The noise suppressor may then suppress the noise in the audio signal according to a set of suppressing parameters, thereby generating a processed signal. For example, the suppressor may apply a certain noise suppression ratio to the incoming signal. This ratio may vary depending on the type and/or quality of the suppressor. For example, a higher quality suppressor may apply a much higher noise suppression ratio, as compared to that for the speech encoder's lower quality native noise suppressor, because of the higher quality noise suppressor's greater capabilities of distinguishing between speech and noise. Therefore, an audio signal with even low signal to noise ratio may be substantially cleaned. The encoder will receive an audio signal with a higher signal to noise ratio, when compared to the input audio signal and therefore it may assume that the audio signal received is a clean speech signal. In this case, in order to reduce the average bit-rate, the encoder will try to encode with low bit rate, i.e., as less important signals, the onsets and offsets of the speech. The processed signals may eventually sound choppy and discontinuous.

Therefore, in the proposed methods and systems when the processed signal is sent from a second noise suppressor (e.g., an external high quality noise suppressor, rather than from a first noise suppressor which may be the speech encoder's native noise suppressor or some other lower quality noise suppressor) to the speech encoder, it is encoded by the speech encoder, at least in part, according to a set of parameters that are modified and/or provided by the second noise suppressor. Thus, when a noise suppressor is changed, for example, from the speech encoder's native noise suppressor to a high quality external noise suppressor, the set of parameters for the encoder to use for encoding may be adjusted accordingly. Examples of encoding parameters that may be changed include a signal to noise ratio table and/or hangover table. These tables are typically used in the encoding process to determine when to switch from high to low bit-rate at the speech offsets and from low to high bit-rate at the speech onsets.

In certain embodiments, a method is provided for improving quality of speech communications in a system having a speech encoder configured to encode a first audio signal using a first set of parameters associated with a first noise suppressor. The method may include receiving a second audio signal, and suppressing noise in the second audio signal by a second noise suppressor to generate a processed audio signal. The method may further include determining a second set of encoding parameters associated with a second noise suppressor and for use by the speech encoder and providing the second set of parameters for use by the speech encoder. The speech encoder may be configured to encode the processed audio signal using the second set of parameters.

The speech encoder may include an enhanced variable rate (EVR) speech codec. In certain embodiments, the speech encoder may improve quality of speech communications by changing an average data rate based on one or more of the second set of parameters provided by the high quality noise suppressor. Changes to the average data rate may be used to change one or more bit rates corresponding to voice quality and/or channel capacity.

A system may be provided for improving quality of speech communications. The system may include a speech encoder configured to encode a first audio signal using a first set of parameters associated with a first noise suppressor, and a communication module for receiving a second audio signal. A suppression module may also be included in the system for suppressing noise in the second audio signal to generate a processed audio signal, and also for determining a second set of parameters associated with a second noise suppressor for use by the speech encoder. The speech encoder may be further configured to encode the processed audio signal into corresponding data based on the second set of parameters.

A method may be provided for improving quality of speech communications, the method comprising receiving first data and instructions associated with a speech encoder, the speech encoder comprising a first noise suppressor, wherein the first data and instructions comprise a first set; receiving second data associated with a second noise suppressor; and replacing at least some of the first data with the second data to create a second set. The second set may be configured for use by a processor of a mobile device. The method may further include compiling the second set prior to execution by the processor. The second set may include a rate determination algorithm, with the second data being parameters including a signal to noise ratio table and/or a hangover period for delaying a shift between different encoding rates for the speech encoder.

An external second noise suppressor and the speech encoder may share data via a memory and/or via a Pulse Code Modulation (PCM) stream. The speech encoder may include a native noise suppressor, a voice activity detector, a variable bit rate speech encoder, and/or a rate determining module.

Embodiments described herein may be practiced on any device that is configured to receive and/or provide audio such as, but not limited to, personal computers, tablet computers, mobile devices, cellular phones, phone handsets, headsets, and systems for teleconferencing applications.

BRIEF DESCRIPTION OF THE DRAWINGS

Embodiments are illustrated by way of example and not limitation in the figures of the accompanying drawings, in which like references indicate similar elements.

DETAILED DESCRIPTION

Figure 1:
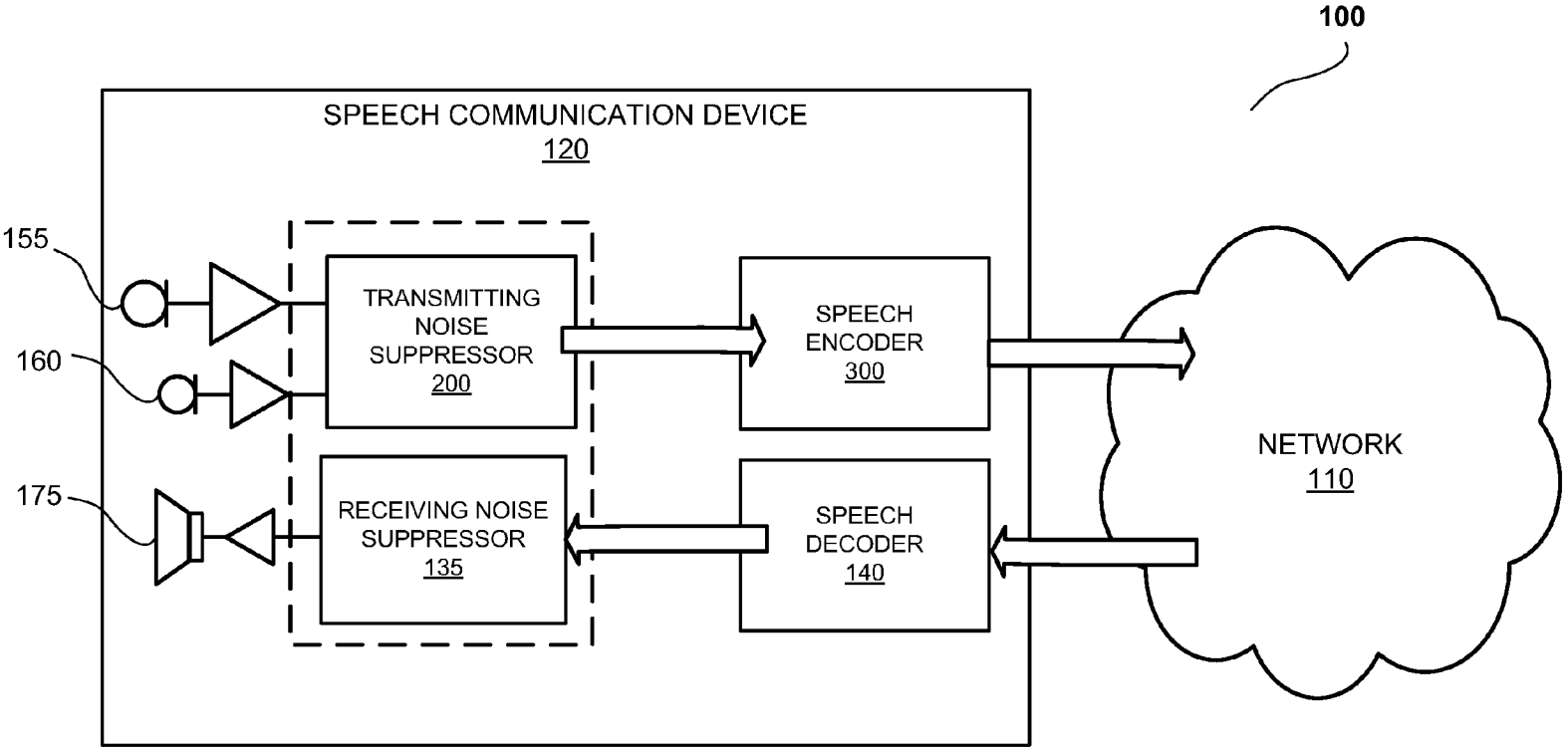
FIG. 1 is a block diagram of an example communication device environment.

Various aspects of the subject matter disclosed herein are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspects may be practiced without these specific details. In other instances, well-known structures and devices are shown in block diagram form in order to facilitate describing one or more aspects.

The following publications are incorporated by reference herein in their entirety, as though individually incorporated by reference for purposes of describing various specific details of speech codecs. In the event of inconsistent usages between this document and those documents so incorporated by reference, the usage in the incorporated reference(s) should be considered supplementary to that of this document; for irreconcilable inconsistencies, the usage in this document controls.

EVRC (Service Option 3), EVRC-B (Service Option 68), EVRC-WB (Service Option 70), EVRC-NW (Service Option 73): 3GPP2 C.S0014-D; SMV (Service Option 30): 3GPP2 C.S0030-0 v3.0; VMR-WB (Service Option 62): 3GPP2 C.S0052-0 V1.0; AMR: 3GPP TS 26.071; AMR VAD: 3GPP TS 26.094; WB-AMR: 3GPP2 TS 26.171; WB-AMR VAD: 3GPP2 TS 26.194; G.729: ITU-T G.729; G.729 VAD: ITU-T G.729b.

Speech encoding involves compression of audio signals containing speech and converting these signals into a digital bit stream. Speech encoding may use speech-specific parameter estimation based on audio signal processing techniques to model speech signals. These techniques may be combined with generic data compression algorithms to represent the resulting modeled parameters in a compact data stream. Speech coding is widely used in mobile telephony and Voice over Internet Protocol (VoIP). Much statistical information concerning the properties of speech is currently available and unlike other forms of audio, speech may be encoded using less data compared to other audio signals. Speech encoding criteria may be directed to various properties, such as, for example, intelligibility and "pleasantness". The intelligibility of speech may include the actual literal content, speaker's identity, emotions, intonation, timbre, and other characteristics. Generally, speech coding may have low coding delay, as long coding delays interfere with speech communications.

The quality of speech coding may be greatly affected by background noises. To reduce noises and improve speech encoding, various noise suppression techniques and devices (i.e., noise suppressors) are utilized. These techniques are sometimes referred to as active noise control (ANC), noise cancellation, or active noise reduction (ANR). They involve reducing unwanted portions of the signal that are not attributable to the speech. Removing noise from speech generally allows improving quality of encoding and/or reducing resource consumption. For example, portions of the audio signal containing only noise or predominantly noise do not need to be encoded at bit rates as high as portions containing predominantly speech. Therefore, a noise suppressor can substantially improve or worsen performance of the corresponding encoder.

Some speech encoders may include native noise suppressors as well as a voice activity detector (VAD), sometimes referred to as a speech activity detector. VAD techniques may involve determining presence or absence of human speech and can be used to facilitate speech processing. For example, some speech encoding processes may be deactivated during non-speech portions of the signal, i.e., when no one is speaking, to save processing, communication, and other types of bandwidth.

Speech encoding is becoming a standard feature in many modern devices and applications that are used in generally uncontrolled environments, such as public places. As such, higher quality noise suppression becomes more important. Furthermore, these devices generally have some resources (e.g., processing resources, power resources, signal transmission resources) available for speech encoding and, therefore, higher quality noise suppression may free these resources for improving the quality of encoded speech. Therefore, noise suppressors may be replaced with more powerful and better quality noise suppressors. This however may result in problems as the existing speech decoders are not tuned to these new high quality noise suppressors.

When an embedded noise suppressor is replaced with a high quality noise suppressor, different signal to noise ratios may result. Because of different signal to noise ratios and/or other characteristics of the processed signal received from the new suppressor, the output from the same speech encoder may be different. The result may be sub-optimal encoding when a speech encoder is tuned to one suppressor, which is later replaced with another suppressor having substantially different characteristics. One such example may be replacement of a low quality microphone with a high quality microphone. The tuned parameters may cause substantially lower voice quality and/or insufficient utilization of network resources in some operating conditions. For example, a noise signal coming from a high quality noise suppressor may be so relatively clean that the encoder may misinterpret the cleaned speech (i.e. the output of the high quality noise suppressor) as actual clean speech and proceed with encoding at a lower data rate typically reserved for some low energy part of the cleaned speech, thereby creating choppy speech sound. Similarly, a noise signal may be misclassified as speech and encoded at a higher data rate, thereby using the network resources in an inefficient way.

Methods and systems described herein may involve a noise suppressor modifying (and/or providing) parameters used by the speech encoder for encoding. More specifically, the speech encoder may use a variable set of encoding parameters. The set of encoding parameters may be initially tuned to the characteristics of the speech encoder's native noise suppressor. The encoding parameters may include, for example, a signal to noise ratio table or a hangover table of the speech encoder. According to various embodiments, these parameters used by the speech encoder may be adjusted when an external noise suppressor is used, the external noise suppressor having different characteristics and parameters than those for the speech encoder's native noise suppressor. For example, a change in noise suppression rate due to use of an external higher quality noise suppressor may impact various characteristics of the speech encoder.

In addition to modifying the encoding parameter, the noise suppressor may also share suppressing parameters (i.e., classification data) with the speech encoder, such as the estimated speech to noise ratio (SNR) and/or specific acoustic cues, which may be used to encode various audio signals with different data rates. (The providing of classification data by the noise suppressor to improve the overall process is further described in U.S. patent application Ser. No. 13/288,858, which is hereby incorporated by reference in its entirety.)

Modified encoding parameters may be provided by the noise suppressor for use by the speech encoder via a memory which may be a memory internal to the speech encoder, e.g., a register, or an external memory. The modified encoding parameter may also be exchanged directly with the speech encoder (e.g., via the Least Significant Bit (LSB) of a PCM stream). The LSB of a PCM stream may be used, for instance, when the high quality noise suppressor and speech encoder do not share a memory. In some embodiments, the LSB stealing approach can be used where the high quality noise suppressor and speech encoder are located on different chips or substrates that may or may not both have access to a common memory. The encoder parameters may be modified or shared for reconfiguring the encoding parameters on-the-fly, which may be desired, for example, when changing from a two microphone/headphone arrangement to a single microphone/headset arrangement, each having different noise suppressor characteristics.

Typically, a speech encoder encodes less important audio signals with a lesser quality low rate (e.g., Quarter Rate in CDMA2000 codecs, such as EVRC-B SMV etc.), while encoding more important data with a higher quality data rate (e.g., Full Code Excited Linear Prediction). However, an encoder may misclassify the audio signal received from an external high quality noise suppressor, because such processed signal has a better signal to noise ratio or some other parameters than the signal for which the speech encoder was designed and tested (i.e., designed and tested for the signal from the original native noise suppressor). To avoid artifacts, such as large changes in the decoded signal resulting from differences among coding schemes to accurately reproduce the input signal energy, a scaling factor may be provided to scale the signal in the transition areas. This resultant smoothing of energy transitions improves the quality of the encoded audio.

The improved tuning of the speech encoder based on the modification of encoding parameters provided by a high quality noise suppressor may be used to provide additional bandwidth and/or improve the overall quality of encoding. In some example embodiments, bandwidth may be saved by lowering the data rate of noise to further improve the speech signal. Additionally or alternatively, this spare bandwidth may be used to improve channel quality to compensate for poor channel quality, for example, by allocating the bandwidth to a channel encoding which may recover data loss during the transmission in the poor quality channel. The spare bandwidth may also be used to improve channel capacity.

FIG. 1 is a block diagram of an example communication device environment 100. As shown, the environment 100 may include a network 110 and a speech communication device 120. The network 110 may include a collection of terminals, links and nodes, which connect together to enable telecommunication between the speech communication device 120 and other devices. Examples of network 110 include the Internet, which carries a vast range of information resources and services, including various Voice over Internet Protocol (VoIP) applications providing for voice communications over the Internet. Other examples of the network 110 include a telephone network used for telephone calls and a wireless network, where the telephones are mobile and can move around anywhere within the coverage area.

The speech communication device 120 may include a mobile telephone, a smartphone, a Personal Computer (PC), notebook computer, netbook computer, a tablet computer, or any other device that supports voice communications and/or has audio signal capture and/or receiving capability as well as signal processing capabilities. These characteristics and functions of the speech communication device 120 may be provided by one or multiple components described herein. The speech communication device 120 may include a transmitting noise suppressor 200, a receiving noise suppressor 135, a speech encoder 300, a speech decoder 140, a primary microphone 155, a secondary microphone 160 (optional), and an output device (e.g., a loudspeaker) 175. The speech encoder 300 and the speech decoder 140 may be standalone components or integrated into a speech codec, which may be software and/or hardware capable of encoding and/or decoding a digital data stream or signal. The speech decoder 140 may decode an encoded digital signal for playback via the loudspeaker 175. Optionally, the digital signal decoded by the speech decoder 140 may be processed further and "cleaned" by the receiving noise suppressor 135 before being transmitted to the loudspeaker 175.

The speech encoder 300 may encode a digital audio signal containing speech received from the primary microphone 155 and from the secondary microphone 160 via the transmitting noise suppressor 200. Specifically, the audio signal from one or more microphones is first received at the transmitting noise suppressor 200. The transmitting noise suppressor 200 suppresses noise in the audio signal according to its suppressing parameters to generate a processed signal. As explained above, different transmitting noise suppressors will suppress the same signal differently. Different types of suppression performed by the transmitting noise suppressor 200 may greatly impact performance of the speech encoder, particularly during transitions from the voice portions to the noise portions of the audio signal. The switching points for the encoder between these types of portions in the same audio signal will depend on the performance of the noise suppressor.

The processed signal may be provided to the speech encoder 300 from the transmitting noise suppressor 200. The speech encoder 300 may use parameters (e.g., a set of parameters) modified by or provided by the transmitting noise suppressor 200 to encode a processed signal from the transmitting noise suppressor 200 into the corresponding data. Alternatively, the speech encoder 300 may use the parameters of the speech encoder's own integrated native noise suppressor, or default parameters to determine and adjust its own encoding parameters used to encode a signal processed by the native noise suppressor into the corresponding data.

Figure 2:
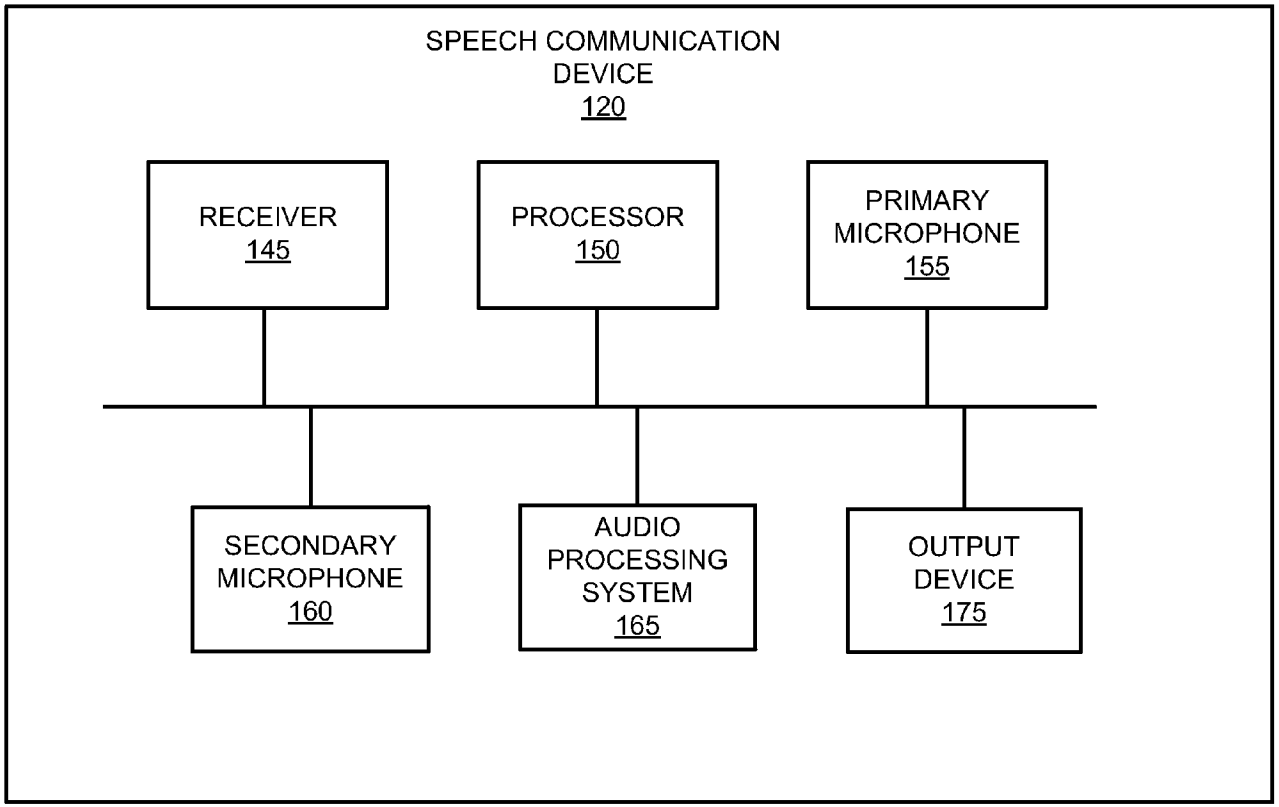
FIG. 2 is a block diagram of an example communication device implementing various embodiments described herein.

FIG. 2 is a block diagram of the example speech communication device 120 implementing embodiments. The speech communication device 120 is an audio receiving and transmitting device that includes a receiver 145, a processor 150, the primary microphone 155, the secondary microphone 160, an audio processing system 165, and the output device 175. The speech communication device 120 may include other components necessary for speech communication device 120 operations. Similarly, the speech communication device 120 may include fewer components that perform similar or equivalent functions to those depicted in FIG. 2.

The speech communication device 120 may include hardware and software, which implement the noise suppressor 200 and/or the speech encoder 300 described above with reference to FIG. 1. Specifically, the processor 150 may be configured to suppress noise in the audio signal according to suppressing parameters of the noise suppressor 200 in order to generate a processed signal and/or to encode the processed signal into corresponding data according to a variable set of encoding parameters of the speech encoder. In certain embodiments, one processor is shared by the noise suppressor 200 and speech encoder 300. In other embodiments, the noise suppressor 200 and the speech encoder 300 have their own dedicated processors, e.g., one processor dedicated to the noise suppressor 200 and a separate process dedicated to speech encoder 300.

The example receiver 145 may be an acoustic sensor configured to receive a signal from a communication network, for example, the network 110. In some example embodiments, the receiver 145 may include an antenna device. The signal may then be forwarded to the audio processing system 165 and then to the output device 175. For example, the audio processing system 165 may include various features for performing operations described in this document. The features described herein may be used in both transmit and receive paths of the speech communication device 120.

The audio processing system 165 may be configured to receive the acoustic signals from an acoustic source via the primary and secondary microphones 155 and 160 (e.g., primary and secondary acoustic sensors) and process the acoustic signals. The primary and secondary microphones 155 and 160 may be spaced a distance apart in order to allow for achieving some energy level difference between the two. After reception by the microphones 155 and 160, the acoustic signals may be converted into electric signals (i.e., a primary electric signal and a secondary electric signal). The electric signals may themselves be converted by an analog-to-digital converter (not shown) into digital signals for processing, in accordance with some embodiments. In order to differentiate the acoustic signals, the acoustic signal received by the primary microphone 155 is herein referred to as the "primary acoustic signal", while the acoustic signal received by the secondary microphone 160 is herein referred to as the "secondary acoustic signal". It should be noted that embodiments may be practiced utilizing any number of microphones. In example embodiments, the acoustic signals from output device 175 may be included as part of the (primary or secondary) acoustic signal. The primary acoustic signal and the secondary acoustic signal may be processed by the same combination of the transmitting noise suppressor 200 and speech encoder 300 to produce a signal with an improved signal to noise ratio for transmission across a communications network and/or routing to the output device.

The output device 175 may be any device which provides an audio output to a listener (e.g., an acoustic source). For example, the output device 175 may include a loudspeaker, an earpiece of a headset, or handset on the communication device 120.

In various embodiments, where the primary and secondary microphones are omni-directional microphones that are closely-spaced (e.g., 1-2 cm apart), an array processing technique may be used to simulate forward-facing and backward-facing directional microphone responses. (An exemplary system and method for utilizing omni-directional microphones for speech enhancement is described in U.S. patent application Ser. No. 11/699,732, which is hereby incorporated by reference in its entirety.) A level difference may be obtained using the simulated forwards-facing and backwards-facing directional microphones. The level difference may be used to discriminate speech and noise in, for example, the time-frequency domain, which can be used in noise and/or echo reduction/suppression. (Exemplary multi-microphone robust noise suppression, and systems and methods for utilizing inter-microphone level differences for speech enhancement are described in U.S. patent application Ser. Nos. 12/832,920 and 11/343,524, respectively, which are hereby incorporated by reference in their entirety.)

Various techniques and features may be practiced on any device that is configured to receive and/or provide audio and has processing capabilities such as, but not limited to, cellular phones, phone handsets, headsets, and systems for teleconferencing applications.

Figure 3:
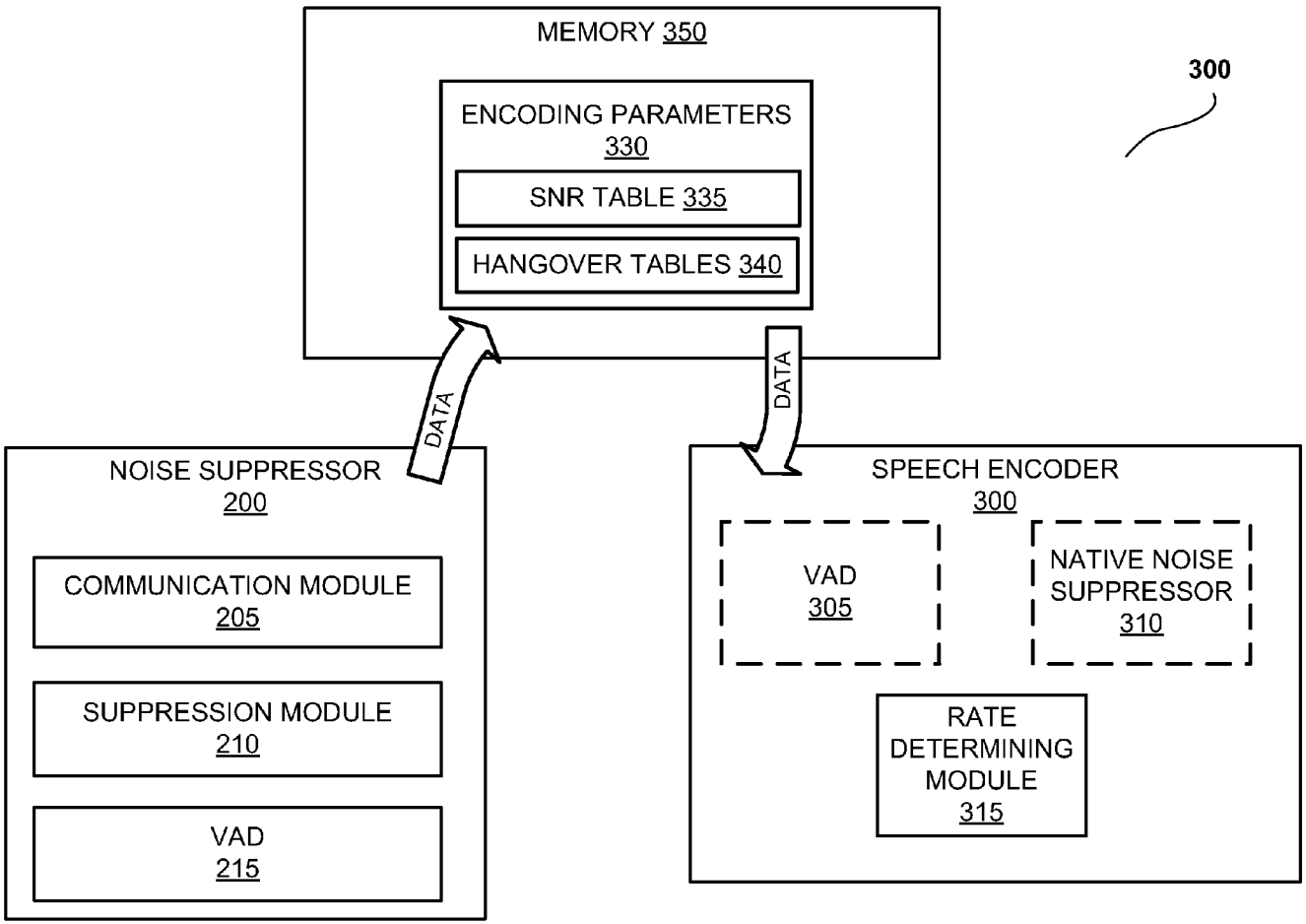
FIG. 3 is a block diagram illustrating providing modified encoding parameters via a memory.

FIG. 3 is a block diagram illustrating providing modified encoding parameters via a memory. The noise suppressor 200 (also referred to herein as the high quality noise suppressor) may include a communication module 205 and a suppression module 210. The suppression module 210 may be capable of accurately separating speech and noise to eliminate the noise and preserve the speech. In certain embodiments, the suppression module 210 may be implemented as a classification module. To perform these noise suppression functions, the suppression module 210 may include one or more suppressing parameters. One of these parameters may be a signal to noise ratio (SNR). Furthermore, suppressing parameters may include acoustic cues, such as stationarity, direction, the inter-microphone level difference (ILD), the inter-microphone time difference (ITD), and other types of acoustic cues. These suppressing parameters may be shared with the speech encoder 300.

The noise suppressor 200 may modify (or provide modified) encoding parameters 330 such as signal to noise ratio (SNR) table 335 and/or hangover tables 340 for use by the speech encoder 300. These tables may be found, for example, in the EVRC-B Rate Decision Algorithm (RDA). The suppression module 210 of the noise suppressor 200 may include a module for providing the modified encoding parameters. The existing parameters in the tables, prior to the modification, may have been configured under the assumption that the speech encoder's lower quality native noise suppressor 310 would be used for noise suppression. The modification of the encoding parameters provided by a high quality noise suppressor may serve to tune the speech encoder to improve the overall quality of encoding and/or provide additional bandwidth.

When the speech encoder's lower quality native noise suppressor is to be used for noise suppression instead of noise suppressor 200, the existing parameters, prior to the modification, may, along with instructions in the rate decision algorithm, form a set of data and instructions that may be compiled prior to execution by a processor (e.g., processor 150 of the speech communication device 120 in FIG. 2). When the noise suppression from an external high quality noise suppressor 200 is to be used instead, the parameters, as modified by the noise suppressor 200, may, along with instructions in the rate decision algorithm, form another set of data and instructions that may be compiled prior to execution by the processor 150. In some embodiments, the modified parameters may be dynamically loaded into a memory by the noise suppressor 200 for use by the speech encoder 300 during encoding.

Adjustments for an SNR table are described further below with reference to FIG. 5. Regarding adjustments for the hangover tables 340, for example, a higher noise suppression ratio of a higher quality suppressor may correspond to a longer or shorter delay in changing the encoding bit rate of the speech encoder in comparison to the speech encoder being coupled to a lower quality suppressor. Specifically, the encoding parameters may be changed as the bit rate of the speech encoder is transitioning from a voice mode (e.g., Voice Activity Detection of 1 or VAD 1) to a noise mode (e.g., Voice Activity Detection of 0 or VAD 0). Transition periods between different modes of compression are handled differently for different noise suppressors. Thus, for a high quality suppressor, transitioning from a voice regime to noise regime involves a longer delay (i.e., longer hangover period before rate change) as the higher quality noise suppressor allows encoding the signal longer at a higher bit rate. At the same time, when switching from the noise regime to the voice regime, a shorter delay (i.e., shorter hangover period) may be used as the higher quality noise suppressor allows encoding the signal at a higher bit rate. In other words, the overall system with a higher quality suppressor becomes more sensitive and responsive to the processed signal. In contrast, when using a lower quality noise suppressor the encoder may mistakenly classify the cleaned speech as clean speech and be aggressive in the VAD thereby increasing the risk of misclassification of speech onsets and offsets as noise. The speech encoded with such an aggressive scheme may sound discontinuous and choppy.

In some embodiments, the encoding parameters are stored in memory 350 as shown in FIG. 3. The modification of the encoding parameters 330 by the noise suppressor 200 may be determined based on analysis of the characteristics of the noise suppressor 200 and may be relative to the characteristics of the speech encoder's native noise suppressor 310. The modification may be based on the suppressing parameters provided by the suppression module 210.

The noise suppressor 200 may include a Voice Activity Detection (VAD) 215, which is also known as speech activity detection or speech detection. VAD techniques are used in speech processing in which the presence or absence of speech is detected. The speech encoder 300 may also include its own native VAD 305. However, the VAD 305 may be inferior to the VAD 215, especially when exposed to different types and levels of noise. Accordingly, the VAD 215 information may be provided to the speech encoder 300 by the noise suppressor 200 with the native VAD 305 of the speech encoder 300 being bypassed.

In general, when an input signal is processed by the noise suppressor 200 before being sent to the speech encoder 300, the resulting processed signal has a reduced noise level such that the speech encoder 300 is presented with a better SNR signal. However, the speech encoder 300 may not operate as intended due to the residual noise if the speech encoder 300 is not tuned to different encoding parameters. Thus, in audio data frames that are being clearly classified by the noise suppressor 200 as a noise-only frame, there may be spectral variations that false-trigger the speech encoder 300. Consequently, the speech encoder 300 may attempt to encode these noise-only frames using a high bit scheme typically reserved for speech frames. This results in the unnecessary consumption of the resources that could be better utilized to improve the encoding of speech. The opposite scenario is also possible when audio data frames that are being clearly classified by the noise suppressor 200 as a speech-only frame may have spectral variations that false-trigger the speech encoder 300. Consequently, the speech encoder 300 may, for example, encode these speech-only frames at a low bit rate typically reserved for noise frames resulting in the loss of valuable information. The speech encoder 300 may also include a rate determining module 315. Certain functionalities of this module are further described below.

This wasting of resources due to misencoding may be especially the case for variable bit rate encoding such as, for example, Adaptive Multi-Rate audio codec (AMR) when running in VAD/DTX/CNG mode or Enhanced Variable Rate Codec (EVRC) and EVRC-B, Selectable Mode Vocoder (SMV) (CDMA networks). The speech encoder may include its own native noise suppressor 310. The native noise suppressor 310 may work by simply classifying audio signal as stationary and non-stationary, i.e., the stationary signal corresponding to noise and the non-stationary signal corresponding to speech and noise. In addition, the native noise suppressor 310 is typically monaural, further limiting its classification effectiveness. The high quality noise suppressor 200 may be more effective in suppressing noises than the native noise suppressor 310 because, among other things, the high quality noise suppressor 200 utilizes an extra microphone, so its classification is intrinsically better than the classification provided by monaural classifier of the encoder. In addition, the high quality noise suppressor 200 may utilize the inter-microphone level differences (ILD) to attenuate noise and enhance speech more effectively, for example, as described in U.S. patent application Ser. No. 11/343,524, incorporated herein by reference in its entirety. When the noise suppressor 200 is implemented in the speech communication device 120, the native noise suppressor 310 of the speech encoder 300 may have to be disabled.

In addition to providing modified encoding parameters, one or more suppressing parameters may be shared by the noise suppressor 200 with the speech encoder 300. Sharing the noise suppression classification data may result in further improvement in the overall process. For example, false rejects typically resulting in speech degradation may be decreased. Thus, for the frames that are classified as noise, a minimum amount of information is transmitted by the speech encoder 300 and if the noise continues, no transmission may be made by the speech encoder 300 until a voice frame is received.

In the case of variable bit rate encoding schemes (e.g., EVRC and EVRC-B, and SMV), multiple bit rates can be used encode different type of speech frames or different types of noise frames. For example, two different rates can be used to encode babble noise, Quarter Rate (QR) or Noise Excited Linear Prediction (NELP). For noise only, QR can be used. For noise and speech, NELP can be used. Additionally, sounds that have no spectral pitch content (low saliency) sounds like "t", "p", and "s" may use NELP as well. Full Code Excited Linear Prediction (FCELP) can be used to encode frames that are carrying highly informative speech communications, such as transition frames (e.g., onset, offset) as these frames may need to be encoded with higher rates. Some frames carrying steady sounds like the middle of a vowel may be mere repetitions of the same signal. These frames may be encoded with lower bit rate such as pitch preprocessing (PPP) mode. It should be understood the systems and methods disclosed herein are not limited to these examples of variable encoding schemes.

When sharing suppressing parameters, acoustic cues may be used to instruct the speech encoder 300 to use specific encoding codes. For example, VAD=0 (noise only) the acoustic cues may instruct the speech encoder to use QR. In a transition situation, for example, the acoustic cues may instruct the speech encoder to use FCELP.

Thus, the audio frames may be preprocessed based on suppression parameters. The speech encoder 300 then encodes the audio frames at a certain bit rate(s). Thus, VAD information of the noise suppressor 200 is provided for use by the speech encoder 300, in lieu of information from the VAD 305. Once the decisions made by the VAD 305 of the speech encoder 300 are bypassed, the information provided by the noise suppressor 200 may be used to lower the average bit rate in comparison to the situation where the information is not shared between the noise suppressor 200 and the speech encoder 300. In some embodiments, the saved data may be reassigned to encode the speech frames at a higher rate.

Figure 4:
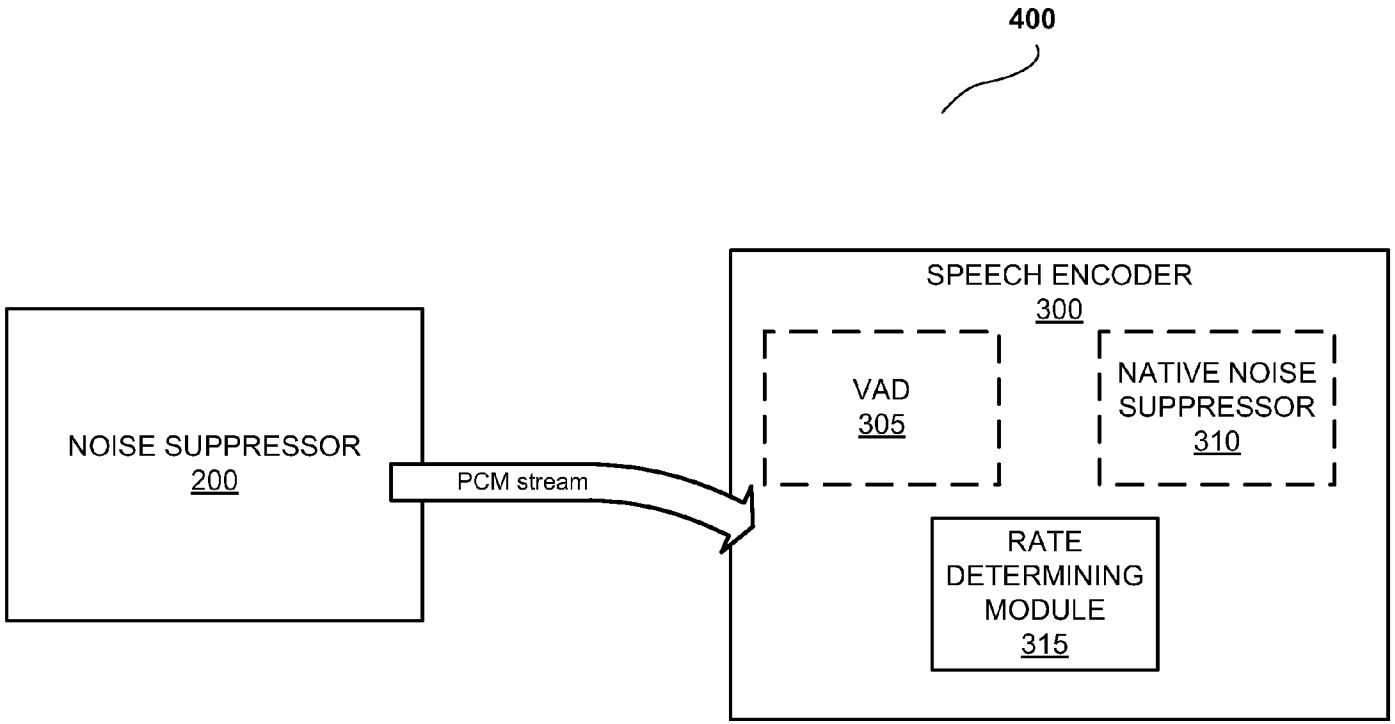
FIG. 4 is a block diagram illustrating sharing parameters via a PCM stream.

FIG. 4 is a block diagram illustrating providing data (e.g., modified encoding parameters, and/or classification data/parameters) to the speech encoder 300 from the noise suppressor 200 via an LSB of PCM stream. If the noise suppressor 200 and the speech encoder 300 are located on two different chips, an efficient way of providing information for use by the speech encoder 300 is to embed the parameters in the LSB of the PCM stream. The resulting degradation in audio quality is negligible, and the chip performing the speech coding operation can extract this information from the LSB of PCM stream or ignore, if not interested in using the information.

Figure 5:
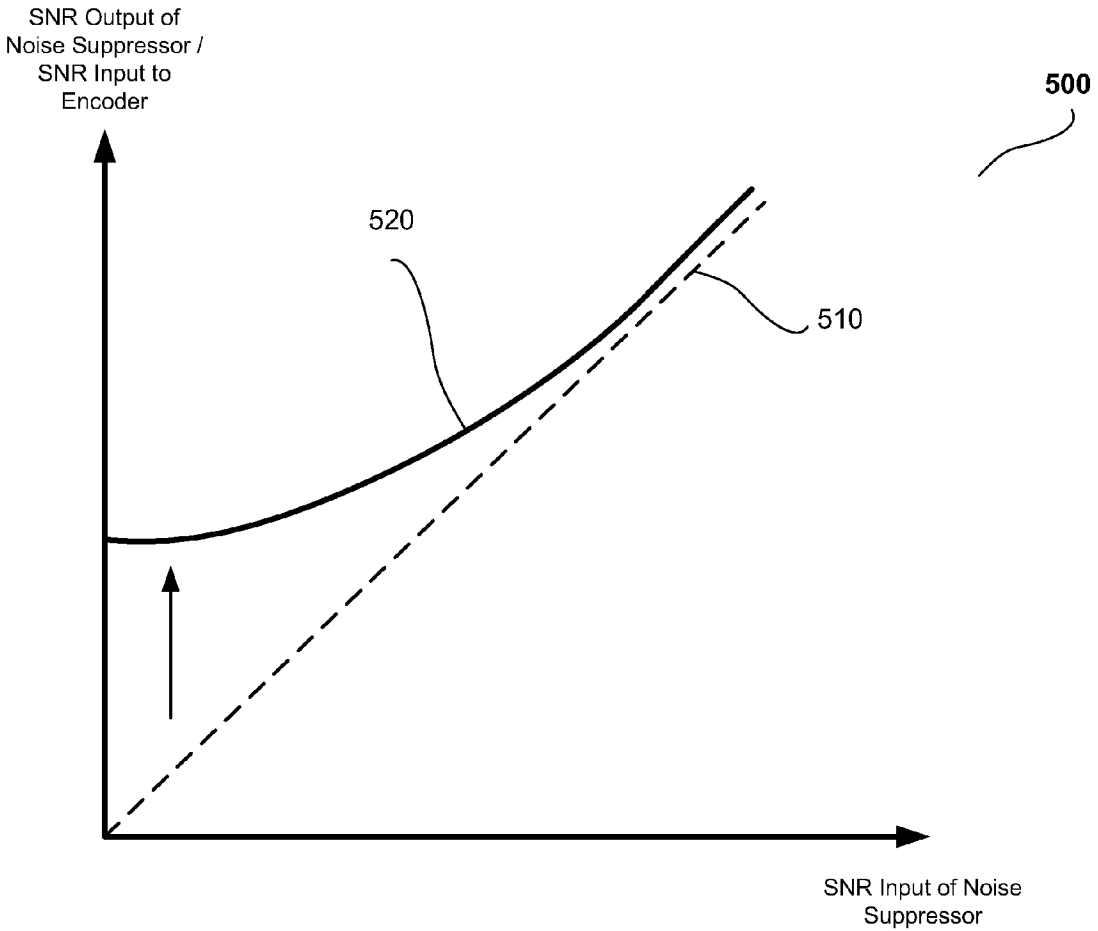
FIG. 5 is a graph illustrating example adjustments to signal to noise ratios to present the speech signal.

FIG. 5 is a graph 500 illustrating example adjustments to signal to noise ratios to present the speech signal. This adjustment may be implemented in the SNR table of the variable set of encoding parameters or some other mechanism. Generally, this type of adjustment (i.e., shifting output SNR values upwards for lower input SNR values) occurs when an initial noise suppressor is replaced with a higher quality noise suppressor. Specifically, a new higher quality noise suppressor will produce a cleaner signal and a portion of speech may be interpreted as noise if the speech encoder is still tuned to the old noise reduction characteristics of the previous lower quality noise suppressor. To avoid this problem, output SNR values are shifted upwards for lower input SNR values while the output SNR values are substantially the same as the input SNR values for higher input SNR values. In other words, the curve shifts upwards (shown as curve 520) from the center line (shown as a dashed line 510) for lower input SNR values. As a result, the encoder would use less aggressive VAD and rate selection and misclassification of speech into noise could be avoided. The shift translated in the encoder to operating more conservatively and preserving the speech signal even for low input SNR values.

Figure 6:
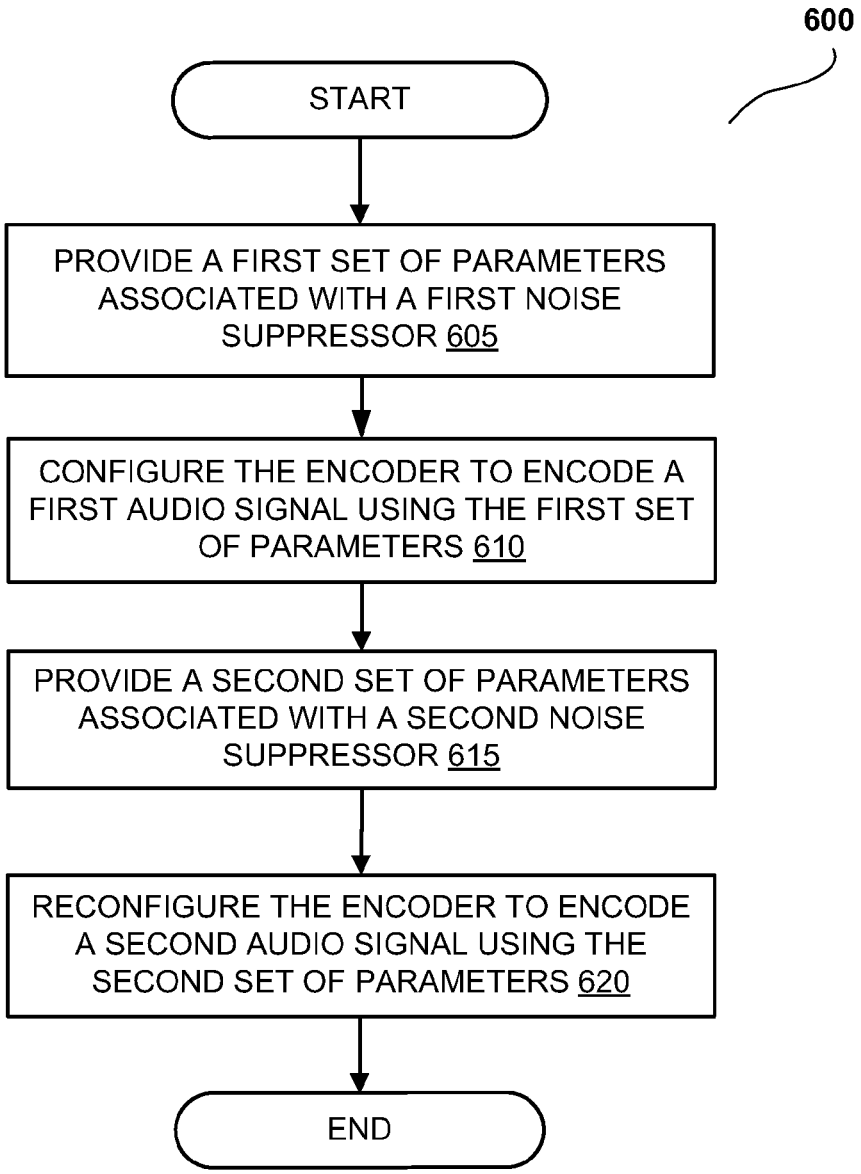
FIG. 6 is a flow chart of an example method for improving quality of speech communications.

FIG. 6 is a flow chart of an example method 600 for improving quality of speech communications. The method 600 may be performed by processing logic that may include hardware (e.g., dedicated logic, programmable logic, microcode, etc.), software (such as run on a general-purpose computer system or a dedicated machine), or a combination of both. In one example embodiment, the processing logic resides at the noise suppressor 200.

The method 600 may be performed by the various modules discussed above with reference to FIG. 3. Each of these modules may include processing logic and may include one or more other modules or submodules. The method 600 may commence at operation 605 with providing a first set of parameters associated with a first noise suppressor. The first set of parameters may also be default parameters intrinsic to the speech encoder and its native noise suppressor.

The method 600 may proceed with configuring the speech encoder to encode a first audio signal using the first set of parameters in operation 610. The parameters may be used for a rate determination algorithm (RDA) of the speech encoder to determine the encoding rate. For example, the speech encoder may be configured in accordance with parameters based on the characteristics of the speech encoder's intrinsic native noise suppressor.

The method 600 may continue with providing a second set of parameters associated with a second noise suppressor in operation 615 and then reconfiguring the encoder to encode a second audio signal using the second set of parameters in operation 620. The second noise suppressor may be a high quality noise suppressor as compared to the native noise suppressor of the speech encoder. For example, the second noise suppressor may have a more precise differentiation between noise and speech (i.e., have a higher quality) and, as a result, have different noise suppression ratio than the first noise suppressor. The second noise suppressor may be an external noise suppressor in addition to the speech encoder or may replace the native noise suppressor.

The second set of parameters may be encoding parameters that include, for example, a signal to noise ratio table or a hangover table of the speech encoder, as further described above. Thus, encoding parameters used by the speech encoder may be adjusted when a second noise suppressor (e.g., an external noise suppressor) is used, the external noise suppressor having different characteristics and parameters than those for the first noise suppressor (e.g., speech encoder's native noise suppressor), as further described above. For example, a change in noise suppression rate due to use of an external higher quality noise suppressor may impact various characteristics of the speech encoder.

Various examples and features of the noise suppressor providing modified encoder parameters for use by the speech encoder are explained above. For example, such sharing may be performed via a memory and/or via a Least Significant Bit (LSB) of Pulse Code Modulation (PCM) of stream. Examples of encoding parameters include a signal to noise ratio, which may be a part of a signal to noise ratio table, and/or a hangover table. Modification of the encoding parameters may involve shifting output SNR values on which the speech encoder may base encoding rate decisions. One such example is presented in FIG. 5 and described above.

While the present embodiments have been described in connection with a series of embodiments, these descriptions are not intended to limit the scope of the subject matter to the particular forms set forth herein. It will be further understood that the methods are not necessarily limited to the discrete components described. To the contrary, the present descriptions are intended to cover such alternatives, modifications, and equivalents as may be included within the spirit and scope of the subject matter as disclosed herein and defined by the appended claims and otherwise appreciated by one of ordinary skill in the art.

What is claimed is:

1. A method for improving quality of speech communications, the method comprising:

configuring a speech encoder using a first set of parameters associated with a first noise suppressor;

receiving a second set of parameters associated with a second noise suppressor;

receiving an audio signal; and reconfiguring the speech encoder to encode the audio signal using the second set of parameters.

2. The method of claim 1, wherein the audio signal originates from the second noise suppressor.

3. The method of claim 1, wherein the second set of parameters comprises a signal to noise ratio.

4. The method of claim 3, wherein the signal to noise ratio is a part of a signal to noise ratio table.

5. The method of claim 1, wherein the second set of parameters comprises a hangover period for delaying a shift between different encoding levels, the hangover period being determined based on a noise suppression rate.

6. The method of claim 3, wherein the second set of parameters further comprises a hangover period for delaying a shift between different encoding levels, the hangover period being determined based on a noise suppression rate.

7. The method of claim 1, wherein the second set of parameters includes one or more acoustic cues comprising at least one of a stationarity, a direction, an inter microphone level difference, and an inter microphone time difference.

8. The method of claim 1, wherein the speech encoder comprises a variable rate speech codec.

9. The method of claim 1, wherein the speech encoder improves the quality of speech communications by changing an average encoding data rate based on one or more of the second set of parameters.

10. The method of claim 9, wherein changes to the average encoding data rate are used to change one or more bit rates corresponding to voice quality and/or channel capacity.

11. The method of claim 1, wherein the second noise suppressor comprises a higher quality noise suppressor than the first noise suppressor, and wherein the reconfiguring comprises shifting signal to noise ratio values.

12. The method of claim 1, wherein the second set of parameters is shared by the second noise suppressor with the speech encoder via a memory.

13. The method of claim 1, wherein the second set of parameters is shared by the second noise suppressor with the speech encoder via a Least Significant Bit of a Pulse Code Modulation (PCM) stream.

14. A system for improving quality of speech communications, the system comprising:

a speech encoder configured to encode an audio signal using a first set of parameters associated with a first noise suppressor;

a communications module of a second noise suppressor, stored in a memory and running on a processor, the communications module configured to receive the audio signal; and a suppression module of the second noise suppressor, stored in the memory and running on the processor, the suppression module configured to suppress noise in the audio signal to generate a processed audio signal and to determine a second set of parameters associated with the second noise suppressor for use by the speech encoder, the speech encoder being further configured to receive the processed audio signal and to receive the second set of parameters.

15. The system of claim 14, the second set of parameters being shared with the speech encoder via the memory.

16. The system of claim 14, the second set of parameters being shared by the second noise suppressor with the speech encoder via a Least Significant Bit of a Pulse Code Modulation (PCM) stream.

17. The system of claim 14, wherein the speech encoder includes the first noise suppressor.

18. The system of claim 14, wherein the speech encoder utilizes a signal to noise ratio table and/or a hangover table including one or more parameters of the second set of parameters.

19. The system of claim 14, wherein the speech encoder is a variable bit rate speech encoder.

20. The system of claim 19, wherein the speech encoder comprises a rate determining module.

21. A method for improving quality of speech communications, the method comprising:

configuring a speech encoder using a first set of parameters associated with a first noise suppressor;

receiving an audio signal;

suppressing noise in the audio signal by a second noise suppressor to generate a processed audio signal;

providing the processed audio signal to the speech encoder;

determining a second set of parameters associated with the second noise suppressor; and providing the second set of parameters to the speech encoder, the speech encoder being configured to encode the processed audio signal using the second set of parameters.

22. The method of claim 21, wherein the determining is based on characteristics of the first and second noise suppressors.

23. The method of claim 21, wherein the second set of parameters comprises a signal to noise ratio, the signal to noise ratio being part of a signal to noise ratio table.

24. The method of claim 21, wherein the second set of parameters comprises a hangover period for delaying a shift between different encoding rates.

25. A method for improving quality of speech communications, the method comprising:

receiving, via a first module stored in a memory and running on a processor, first data and instructions associated with a speech encoder, the speech encoder comprising a first noise suppressor, wherein the first data and instructions comprise a first set;

receiving, via a second module stored in the memory and running on the processor, second data associated with a second noise suppressor;

receiving, via a third module stored in the memory and running on the processor, an audio signal; and replacing, via a fourth module stored in the memory and running on the processor, at least some of the first data with the second data to create a second set.

26. The method of claim 25, the second set being configured for use by a processor of a mobile device.

27. The method of claim 26, further comprising compiling the second set prior to execution by the processor.

28. The method of claim 25, wherein the second set comprises a rate determination algorithm.

29. The method of claim 28, wherein the second data comprises parameters including a signal to noise ratio table.

30. The method of claim 28, wherein the second data comprises parameters including a hangover period for delaying a shift between different encoding rates for the speech encoder.

* * * * *